US006109778A

United States Patent [19]

Wilmer

[11] Patent Number: 6,109,778

[45] Date of Patent: Aug. 29, 2000

[54] APPARATUS FOR HOMOGENEOUS MIXING OF A SOLUTION WITH TANGENTIAL JET OUTLETS

[75] Inventor: Jeffrey A. Wilmer, Phoenix, Ariz.

[73] Assignee: United States Filter Corporation, Palm Desert, Calif.

[21] Appl. No.: 08/934,819

[22] Filed: Sep. 22, 1997

[51] Int. Cl.[7] ..... B01F 5/02

[52] U.S. Cl. ..... 366/137; 366/165.2; 366/165.5; 366/173.2; 366/174.1

[58] Field of Search ..... 366/136, 137, 366/165.1–165.4, 167.1, 307, 173.1, 173.2, 174.1, 175.2, 165.5; 4/286, 288, 292

[56] References Cited

U.S. PATENT DOCUMENTS

| | | | |
|---|---|---|---|
| 118,548 | 8/1871 | Oliver . | |
| 626,950 | 6/1899 | Wheelwright . | |
| 687,132 | 11/1901 | Deming | 366/307 |
| 913,742 | 3/1909 | Lewis | 366/307 |
| 975,380 | 11/1910 | Berntson | 366/307 |
| 1,032,663 | 7/1912 | Fay | 366/307 |
| 1,156,946 | 10/1915 | Vendercook | 366/137 |
| 1,160,848 | 11/1915 | Conklin | 366/165.4 |
| 1,192,478 | 7/1916 | Vandercook | 366/165.4 |
| 1,382,992 | 6/1921 | Lombard | 366/136 |
| 1,580,476 | 4/1926 | Fassio | 366/137 |
| 1,596,893 | 8/1926 | Schifter . | |
| 1,918,509 | 7/1933 | Wilcox . | |
| 1,992,261 | 2/1935 | Traudt | 366/173.2 |
| 1,996,279 | 4/1935 | Dillon . | |
| 2,107,390 | 2/1938 | Rosmait | 366/136 |
| 2,135,261 | 11/1938 | Rosmait | 366/136 |
| 2,522,300 | 9/1950 | Richard | 366/165.1 |
| 2,528,094 | 10/1950 | Walker | 366/165.2 |
| 2,528,514 | 11/1950 | Harvey et al. . | |
| 2,582,198 | 1/1952 | Etheridge . | |
| 2,590,431 | 3/1952 | Rose | 366/307 |
| 2,603,460 | 7/1952 | Kalinske | 366/173.2 |
| 2,647,732 | 8/1953 | Jarman . | |
| 2,906,607 | 9/1959 | Jamison | 366/165.4 |
| 2,997,373 | 8/1961 | Stephens . | |
| 3,291,456 | 12/1966 | Deane . | |
| 3,586,294 | 6/1971 | Strong . | |
| 3,846,079 | 11/1974 | Alagy et al. . | |
| 3,871,272 | 3/1975 | Melandri | 366/137 |
| 4,097,026 | 6/1978 | Haindl . | |
| 4,187,029 | 2/1980 | Canale et al. . | |
| 4,534,655 | 8/1985 | King et al. | 366/137 |
| 4,875,781 | 10/1989 | Raska | 366/307 |
| 5,607,233 | 3/1997 | Yant et al. . | |
| 5,609,417 | 3/1997 | Otte | 366/173.2 |
| 5,724,684 | 3/1998 | Paar | 4/286 |
| 5,765,945 | 6/1998 | Palmer | 366/167.1 |
| 5,769,536 | 6/1998 | Kotylak | 366/167.1 |
| 5,799,339 | 9/1998 | Perry et al. | 4/286 |

FOREIGN PATENT DOCUMENTS

| | | | |
|---|---|---|---|
| 95/03120 | 2/1995 | WIPO | 366/137 |

*Primary Examiner*—Charles E. Cooley
*Attorney, Agent, or Firm*—Wolf, Greenfield & Sacks, P.C.

[57] ABSTRACT

An apparatus and method for homogeneous mixing and delivery of a solution, such as a colloidal suspension, the apparatus comprising a holding vessel for holding a solution body, a jet mixing device situated coplanar with a solution level in the holding vessel, the jet mixing device having a plurality of jets having tangential outlets positioned to discharge a stream of solution against interior walls of the holding vessel at a ballistic angle $\Theta_2$ in relation to a solution level in the holding vessel thereby creating a helical flow in said solution body. The apparatus may also include a whirlpool reduction cap and flow diverters.

23 Claims, 9 Drawing Sheets

APPARATUS FOR HOMOGENEOUS MIXING OF A SOLUTION WITH TANGENTIAL JET OUTLETS

FIELD OF THE INVENTION

The present invention relates, in general, to a mixing apparatus and method for circulating and agitating a solution to provide a homogeneous mixture of the solution. More particularly, the invention relates to a mixing apparatus for maintaining homogeneity of a colloidal suspension, such as a chemical slurry.

BACKGROUND OF THE INVENTION

Various means for mixing solutions are known in the art. Both intrusive and non-intrusive means have been used to mix solutions, including colloidal suspensions, to prevent separation of homogeneous solutions into constituent components and/or to reconstitute solutions that have separated into constituent elements. Intrusive mixing devices, or those objects and devices which are inserted into a solution to agitate the solution with the assistance of an external power source, are well known. Such devices involve the use of intrusive mechanical mixers powered by electric or pneumatic motors. These devices provide relatively high torque and/or rotation of the solution and may result in adverse effects on the solution as a result of the formation of a significant vortex or whirlpool in the solution.

In some chemical environments, further adverse effects of intrusive agitation can be seen in the form of foaming or gelling of the body of solution while it is being mixed in a mixing tank or similar holding vessel. Such foaming or gelling may change the parameters of solutions' various chemical compositions and adversely affect their performance. Additionally, intrusive mixing devices and methods may introduce air into the mixture or solution and may cause oxidation of certain chemicals mixtures thereby changing the chemical reactivity of the solution.

Moreover, intrusive mixing devices frequently are comprised of metallic alloys, which may interact unfavorably with solutions of various chemical compositions. Over time, residual wear from a shaft used in an intrusive mixing system may cause the introduction of impurities into solutions as they are mixed. Coated shafts with chemically compatible plastic material last for longer periods of time, but still are problematic when used in abrasive solutions, such as slurry used in chemical mechanical polishing (CMP) of semiconductor wafers, because the abrasive characteristics of such solutions may wear on the coatings and, again, cause introduction of impurities into the solutions during mixing.

Moving parts in intrusive mixing devices (such as bearings, pins, and contact surfaces) also require periodic maintenance. Pneumatic motors demand continual lubrication by an in-line lubricator device. Additionally, exhaust from such motors must be vented to prevent atmospheric contamination when used in a clean room environment; the need to engage in such venting may contribute to an increase in routine maintenance. Finally, the space required for housing such motors and power supplies and the size of the motors and power supplies may create safety hazards and other considerations during routine operations of maintenance and normal use in a chemical environment.

Non-intrusive mixing devices have been developed to overcome some of the problems associated with intrusive mixing devices. As used herein, the term "non-intrusive" mixing device refers to an object placed in-line to the flow path of a fluid or solution stream to enhance agitation by direct interference. Such devices include, but are not limited to, sparger systems, baffles, fins, in-line spiral pipings, where solution is rotated around a central twisted, or spiral, elongated pipe and/or alteration of a fluid or solution path into a fluid or solution body.

One of the most widely used non-intrusive mixing systems of the prior art involves the use of a sparger head system, as shown in FIG. 1. In this system, a flow line 2 having an end 4 is introduced into a vessel 6 containing a solution body 8 having a solution level 7. Flow line 2 extends either from the top of the holding vessel, as shown in FIG. 1, or may enter through the bottom of the holding vessel. A sparger head 9 is placed at the end of flow line 2 located below the solution level at a specified orientation in the holding vessel. Solution enters the flow line and is delivered through flow line 2 and exits the sparger head into the solution body. A conical dispersion pattern is created in the solution body as illustrated in FIG. 1.

Testing regarding this system has shown that over time as the system approaches a steady state, the flow path of the solution stream entering the solution body is limited as to the volume of material with which it interacts, and separation of solids from the mixed solutions, such as slurry, occurs in regions of little or no agitation. Because the flow pattern of the solution disbursed from the sparger head is conical, and is situated in a limited conical region in front of the sparger, "dead zones" of minimal agitation of the suspension develop over time. These "dead zones" essentially are pockets outside the conical dispersion region where the solution body is not in direct contact with the delivered fluid stream of solution in the holding vessel. Thus, the solution tends to separate into constituent components and become nonhomogeneous in these regions and loses effectiveness. Additionally, regions outside of the conical region, where inadequate mixing occurs, show evidence of build up or caking along the interior peripheral walls of the holding vessel near the base.

SUMMARY OF THE INVENTION

It is an object of this invention to provide a non-intrusive mixing and delivery system which enhances homogeneity of a solution distributed from a holding vessel. To this end, we have developed a multiple jet, helical flow mixing method and apparatus. Homogeneous mixing of a solution is effectuated in a holding vessel containing a solution body as cycled solution is introduced along interior peripheral walls of a holding vessel tangent to the peripheral walls of the holding vessel at an angle, $\Theta_2$, to a horizontal plane of the solution body (hereinafter referred to as the "solution level").

Surface adhesion between the components of the solution and the interior peripheral walls of the holding vessel cause the solution to be held substantially against the peripheral walls of the vessel as the solution cascades down the interior peripheral walls until it collides with the solution body. The particular combination of angles and tangents used in introducing the solution into the solution body create a helical flow mixing effect in the solution body. The helical flow effect is obtained through a novel arrangement of mixing jets. The continuous helical agitation of the solution ensures that the solution remains in a homogeneous, uniform state as it is dispensed from the holding vessel. Additionally, use of the mixing method of the present invention reduces build up or caking observed on the interior walls of prior art non-intrusive mixing systems.

According to a further embodiment of the invention, the holding vessel may be equipped with one of more flow diverters to further enhance the helical flow mixing effect and enhance the homogeneity of the solution.

It is another object of the present invention to reduce vortices normally encountered in cycling solutions for applications such as the mixing and delivery system of the present invention. Thus, according to another embodiment of the invention, the base of the holding vessel may be equipped with a whirlpool reduction cap for reducing vortices encountered in cycling solutions according to the method of the present invention and for reducing build up of settled particles along the base of the holding vessel.

The invention has particular applicability for mixing and delivery of colloidal suspensions, including slurries used in CMP of semiconductor wafers. Such colloidal suspensions are notorious for separating from homogeneous distribution into constituent chemical components. More generally, however, the invention may be used in numerous other applications requiring homogeneous solutions, and it is not contemplated that the invention would be limited to slurry or CMP applications.

Further and other objects of the present invention will become apparent from the description contained herein.

The terms "process", "method", and "technique" are used interchangeably herein.

As used herein, the term "solution" includes liquid/liquid mixtures, chemical compositions, liquid/solid mixtures, colloidal suspensions and slurries, and similar mixtures.

As used herein, the term "fluid" includes liquid, chemical/s, solution/s, and similar materials.

BRIEF DESCRIPTION OF THE SEVERAL VIEWS OF THE DRAWINGS

For a better understanding of the present invention, together with other and further objects, advantages and capabilities thereof, reference is made to the following disclosure and appended claims in connection with the drawings described below:

The depictions shown in the aforementioned Figures are not drawn to scale.

DETAILED DESCRIPTION OF THE INVENTION

Figure 1:
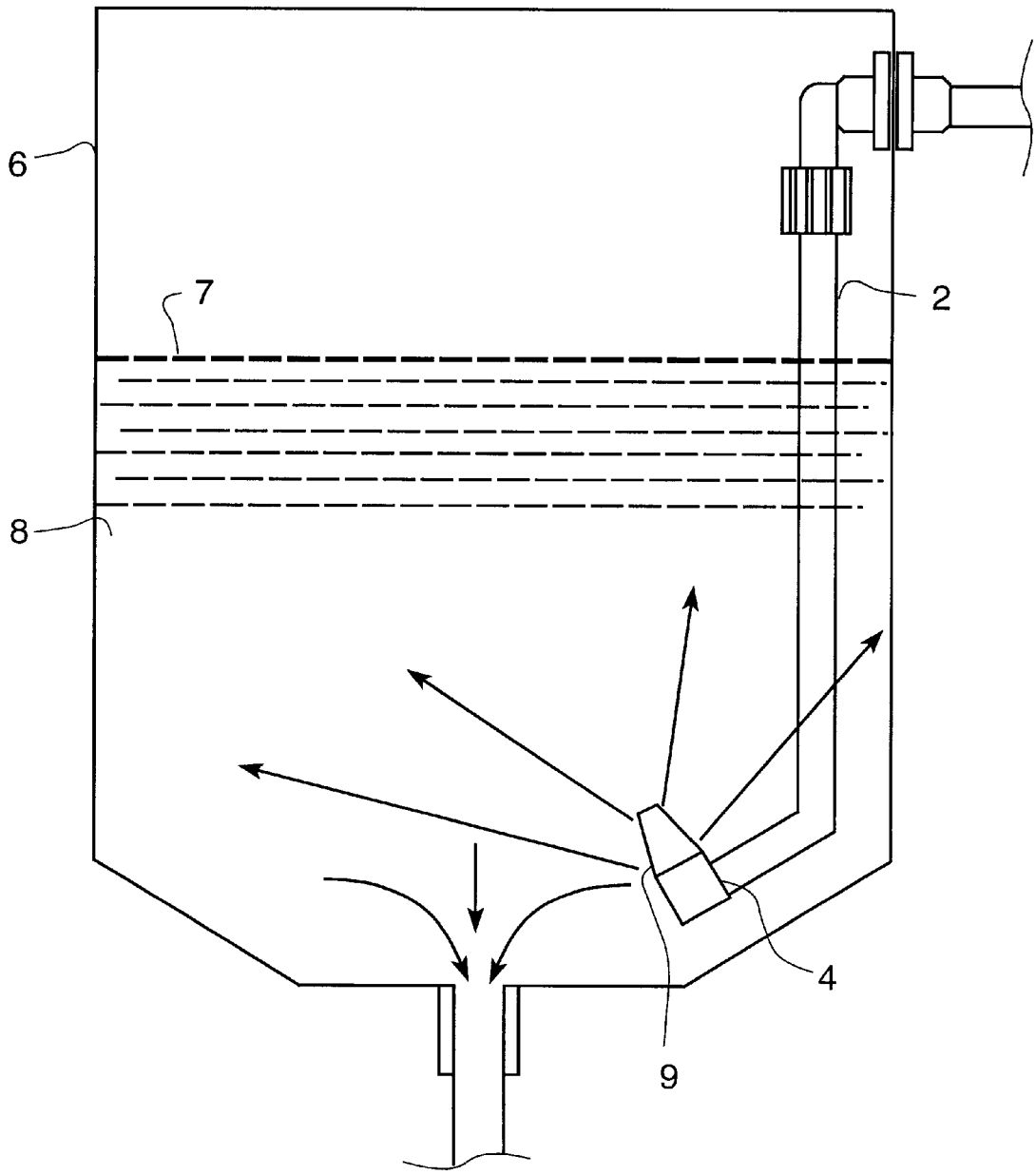
FIG. 1 (PRIOR ART)
FIG. 1 is a side view of a prior art mixing system using a sparger located beneath the solution level in a holding vessel to produce a conical dispersion pattern.
Figure 2:
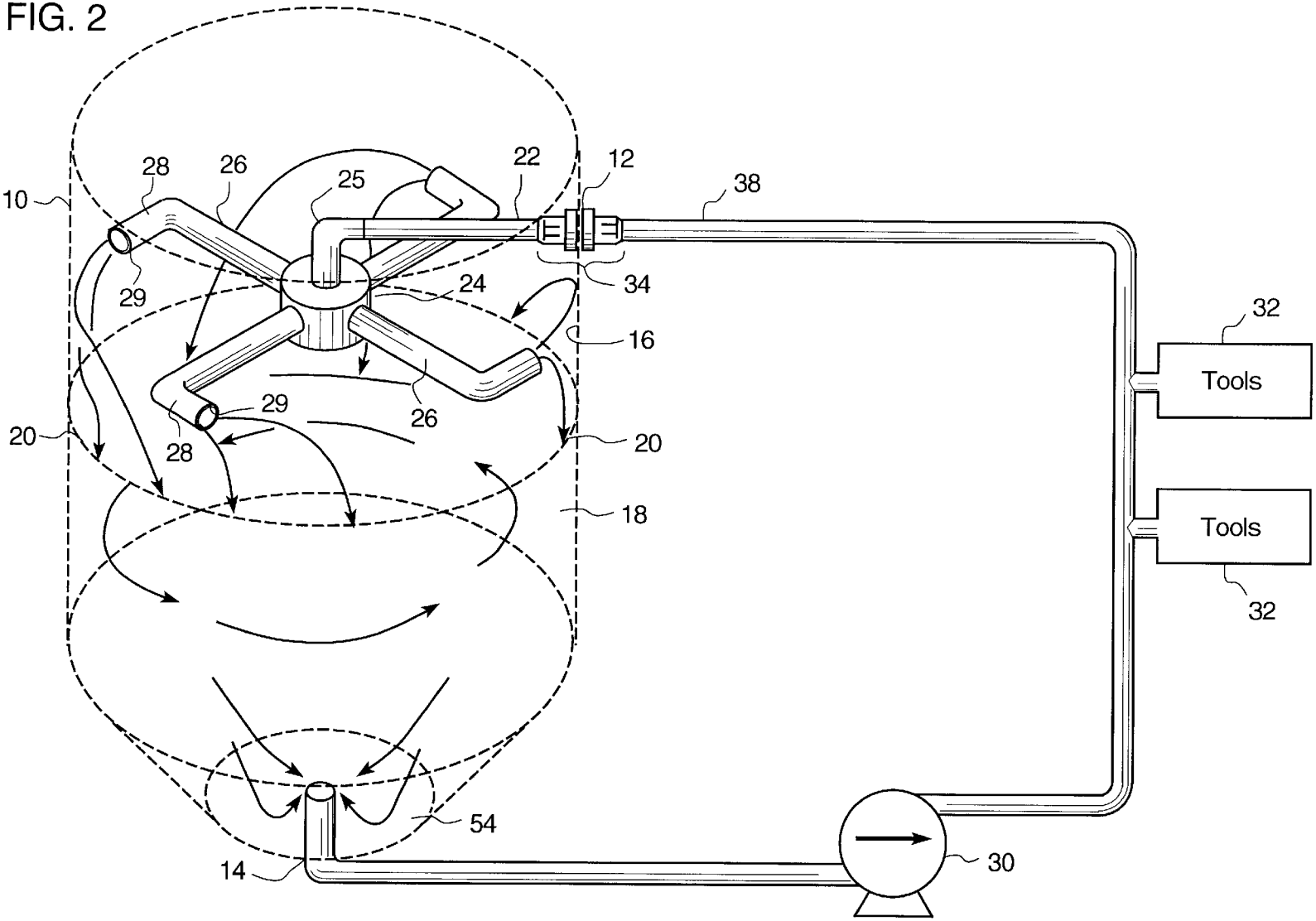
FIG. 2 is a schematic view of one embodiment of the present invention and illustrates continual cycling of a solution using the apparatus and method of the present invention.
Figure 7:
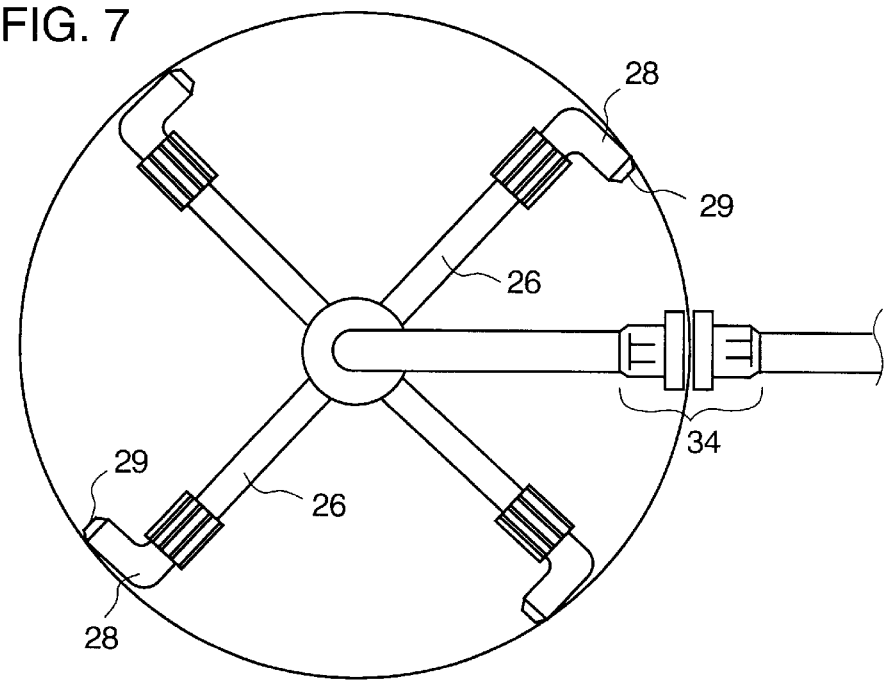
FIG. 7 is a top view of a preferred embodiment of the present invention, showing a four-jet mixer assembly.

Referring now to the drawings, and particularly to FIG. 2, the apparatus of the present invention comprises a cylindrical holding vessel 10, having an inlet 12, an outlet connection 14, and peripheral walls 16. Holding vessel 10 houses a solution body 18 up to a solution level 20. A main delivery line 22 extends through inlet 12 to a point substantially near a center point of holding vessel 10. A dual containment bulkhead, 34, which serves both as a restraint from foreign particles infiltrating and contaminating the interior of holding vessel, 10, and as a mount for the multiple jet mixer assembly is depicted in FIG. 7.

A multiple jet mixer assembly extends from main delivery line 22 in fluid communication therewith. As can be seen in more detail in the overhead view of the multiple jet mixer assembly illustrated in FIGS. 2, 3, 4 and 6, a mixer junction 24 is connected in fluid communication with main delivery line 22 by a 90° elbow fitting 25. Lateral members, or tubes, 26 extend from mixer junction 24 in fluid communication therewith. Jets 28 are connected to respective lateral members 26. The length of lateral members, 26, is such that each jet 28 is touching a surface of an internal peripheral wall of holding vessel 10.

Figure 5:
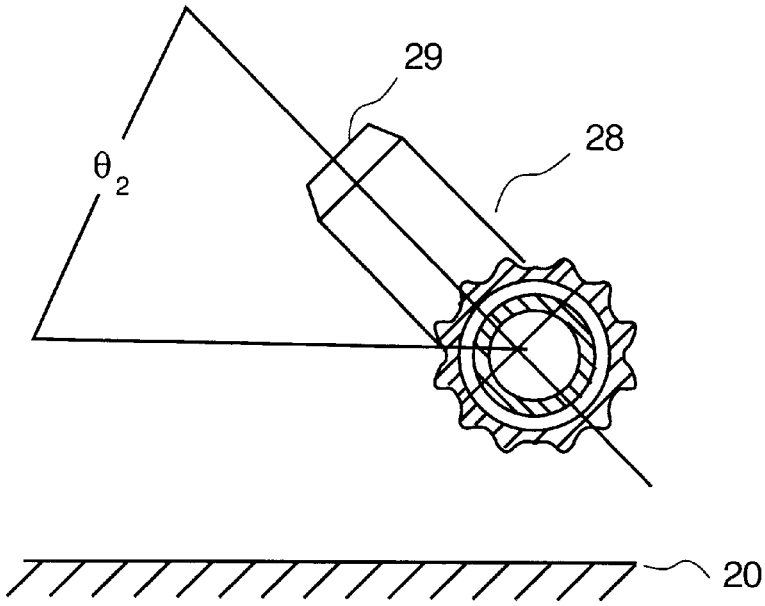
FIG. 5 is a sectional view of FIG. 4 showing orientation of ballistic trajectory angle, $\Theta_2$, of a jet outlet to a plane created by the solution body in the holding vessel. The coplanar plane of the jet path to the solution level is also illustrated.
Figure 6:
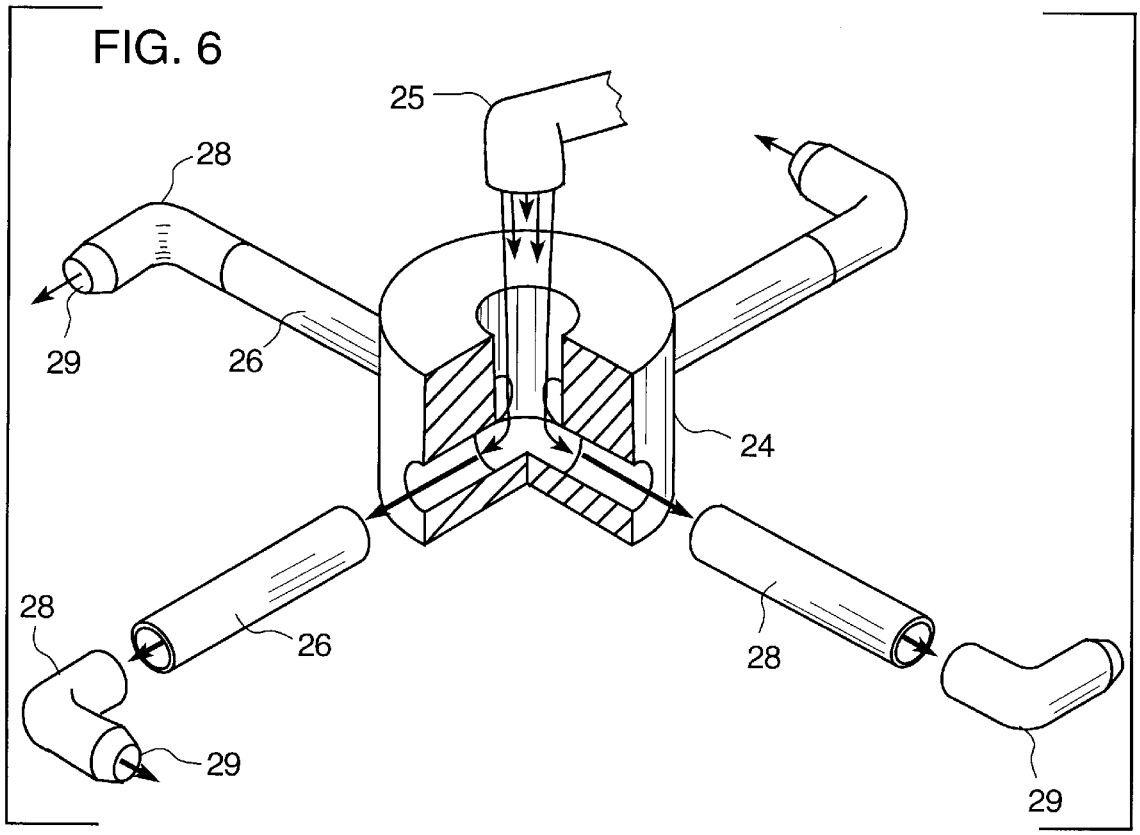
FIG. 6 is an exploded partial view of a preferred embodiment of the jet assembly of the present invention illustrating flow of solution through the jet assembly.

The angular position of jet outlets 29 with respect to other elements are important. As illustrated in FIG. 5, jet outlets 29 are oriented coplanar with respect to the plane of solution level 20. The trajectory of solution as it is introduced into holding vessel 10 is dictated by angle, $\Theta_2$, of the jet outlets 29 with respect to solution level 20. Angle $\Theta_2$ could vary anywhere from 0–360° depending on the diameter, shape, and size of holding vessel 10, but for most applications, a vertical angle $\Theta_2$ to the radial line of each jet outlet 29 parallel to solution level 20 generally will be within the range of 0° to 60°, with a 15° angle being optimal in a four jet assembly used in a 30 gallon holding vessel.

Figure 3:
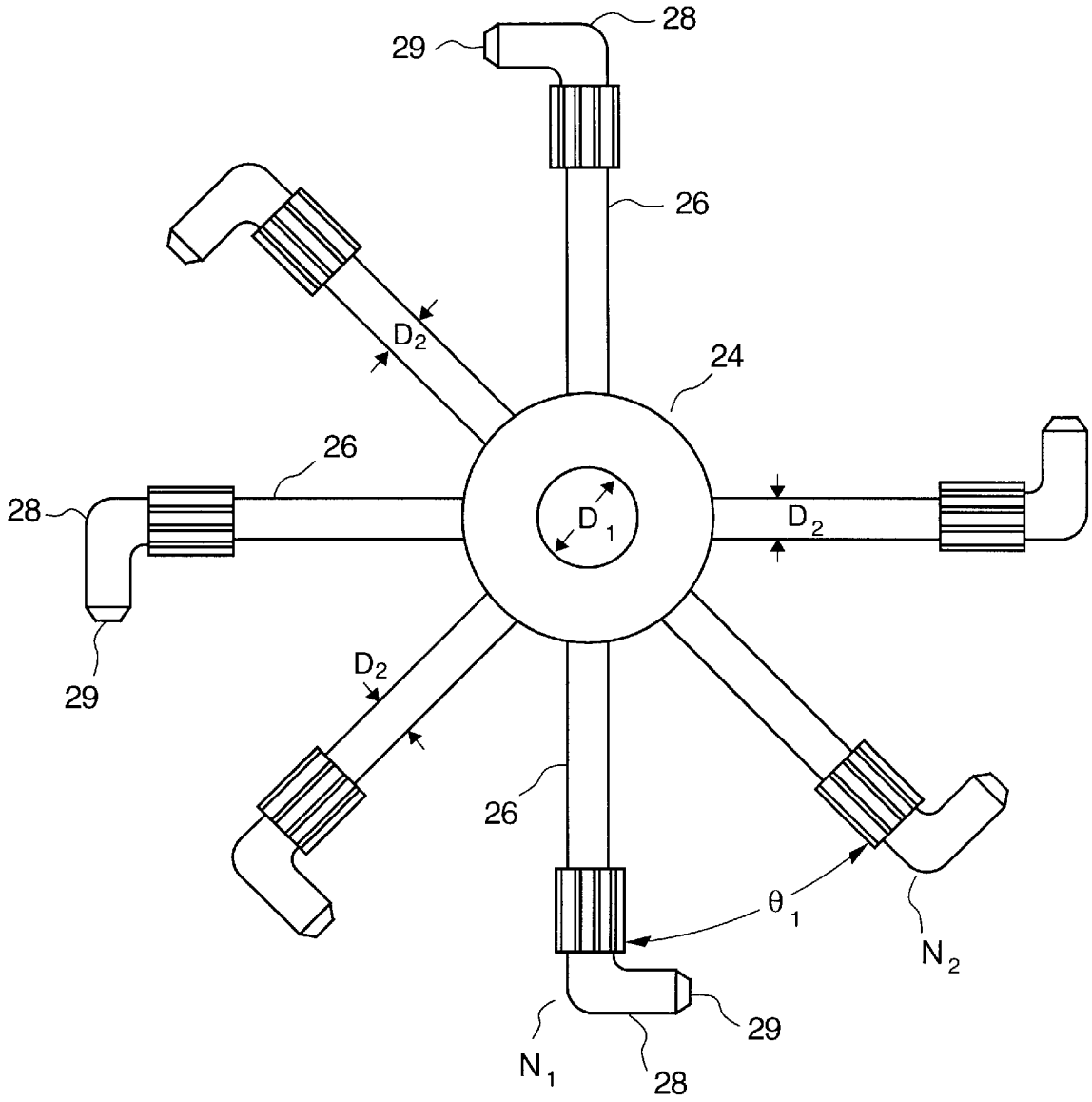
FIG. 3 is a general plan overhead view of a multiple jet mixer assembly of the present invention.

Referring now to FIG. 3, internal diameter, $D_1$, of delivery line, 22, is held constant with the overall internal diameter of supply line 38 of the circulation system. Internal diameter, $D_2$, of tubing of lateral members 26 is chosen such that the sum of the cross sectional areas of each lateral member 26, $\Sigma A_2$, is less than the cross sectional area $A_1$ of delivery line 22. The length of lateral members, 26 will be a length that allows jet 28 to touch an interior peripheral wall of holding vessel 10, although it is not essential that the jets actually touch the wall so long as they are very close to the wall.

Four lateral members 26 and jets 28 are shown in the preferred embodiment of the invention illustrated in FIG. 2.

However, any number of jets from one to infinity may be used. I have found a four-jet mixer assembly to provide optimal mixing when using a 30 gallon holding vessel. The optimal number, $N_N$, of lateral members, and consequentially of jets varies with the size and shape of the holding vessel could be established by the ratio of $1.5=A_1/\Sigma A_2$, where $A_2$ is first chosen and applied to the ratio. All values are rounded off accordingly. The angle, $\Theta_1$, between successive subject lateral member/jet assemblies $N_1$ and $N_2$, is determined by the formula $360°/N_N$.

The entire assembly of the holding vessel 10 and jet assembly may be sealed off from the outside by a vessel lid placed atop of holding vessel 10 (not shown). The entire assembly also may rest on a stand (not shown).

Figure 8:
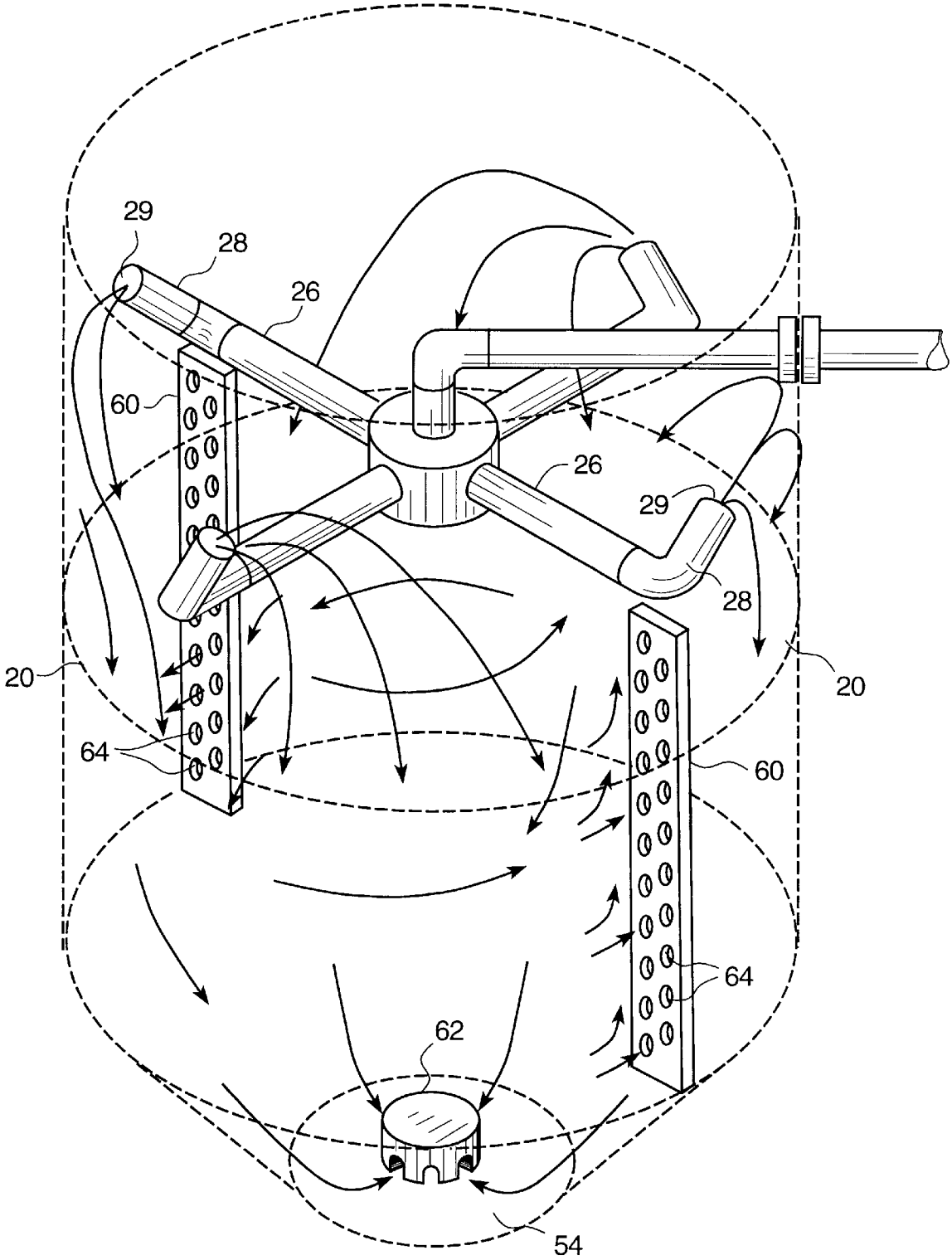
FIG. 8 is an isometric view of another preferred embodiment showing, in combination, the multiple jet mixer, whirlpool reduction cap, and flow diverters of the present invention.

Holding vessel 10 is depicted in FIGS. 2 and 8 as a cylindrical vessel. However, the shape of the holding vessel is not critical in the present invention, and other shaped holding vessels could also be employed. Additionally, although the base of holding vessel 10 is depicted in FIGS. 2 and 8 in a conical form, the form of the base is not critical, and other forms, including, but not limited to, hemispherical and truncated forms, could also be employed.

Figure 4:
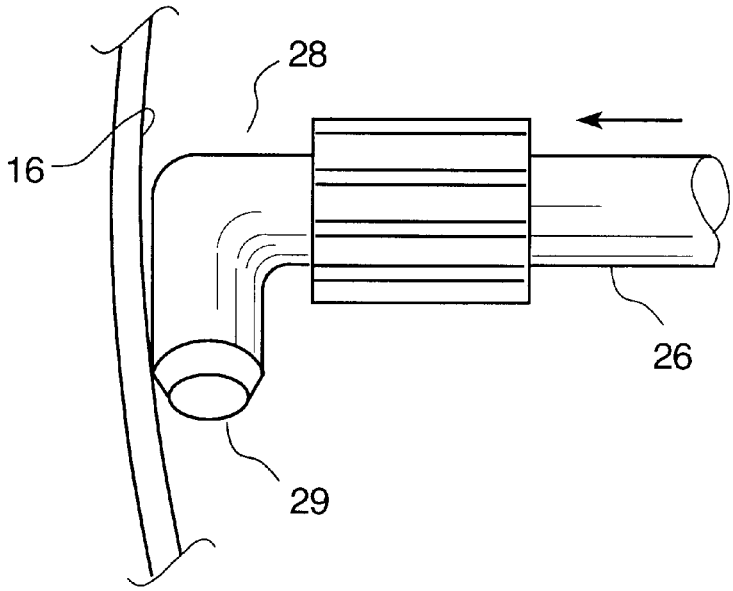
FIG. 4 is a detailed view of a single jet of the multiple jet mixer assembly shown in FIG. 3.

With reference to FIGS. 4 and 8, the described apparatus operates as follows: as solution is introduced through the delivery line, 22, and travels through elbow 25 (shown here as a 900 elbow) to the mixing junction, 24, it is branched off to each jet 28 through tubing 26. As illustrated in FIGS. 4 and 7, each jet outlet 29 is positioned tangent to an interior peripheral wall 16 wherein each jet outlet touches the interior peripheral wall at a single point.

Solution exits jet outlet 29 tangent to an inner surface of the holding vessel 10. Exiting the jet outlets 29 at angle $\Theta_2$, the solution cascades down an internal peripheral wall of holding vessel 10. Surface adhesion between the solution and the peripheral walls 16 of holding vessel 10 hold the cascading solution to a peripheral wall 16 until it collides with the solution body already in holding vessel 10 at solution level 20. As solution cascades down peripheral walls 16 under gravity, the thickness of the solution stream is reduced to a thin sheet until it collides with the solution body in the holding vessel and impedes momentum to begin rotating the entire solution body in holding vessel 10 in a helical pattern toward the base 54 of holding vessel 10 as illustrated in FIG. 8. The collision of the thin solution sheet with the overall solution body reduces folding and splashing and also creates a helical flow which causes homogeneous mixing throughout the vessel. No significant difference was noted in clockwise or counter-clockwise motion of the solution body in the holding vessel.

An outlet connection 14 at base 54 of holding vessel 10 leads to supply line 38 and to a circulating pump 30, through which solution is either circulated to tools 32 that will use the solution, for example in CMP applications where the solution is a colloidal suspension such as slurry, or recirculated back into holding vessel 10 through supply line 38 to main delivery line 22 and back through the multiple jet mixing assembly where the mixing process beings anew.

Figure 9:
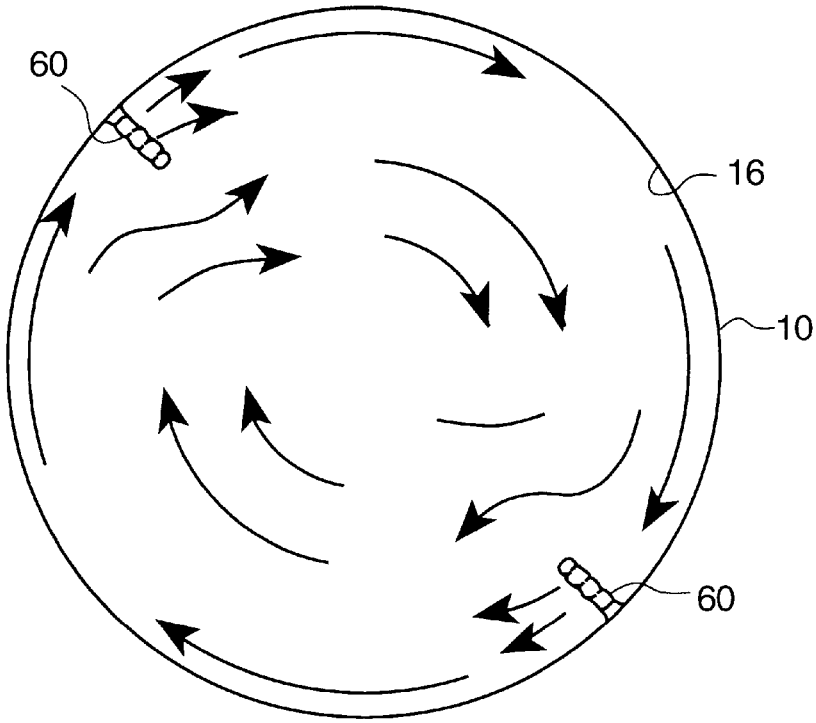
FIG. 9 is a top view of a section cut between the planes created by the jet path and solution level. This figure illustrates the streamlines created at a steady state of the system when in operation.

FIG. 8 represents a modified embodiment of the present invention to include flow diverters 60 and whirlpool reduction cap 62. As the solution body rotates as a result of the tangential introduction of solution into the solution body, settling of suspended solids in the solution body may result from centrifugal forces. This settling effect can be reduced by the application flow diverters 60. Flow diverters aid to channel the slurry suspension toward the center of the solution body and to improve the overall homogeneity of the solution body as illustrated in FIG. 9. The flow diverters, 60, may contain orifices 64 which have a dual function: (1) to assist in attaining a steady rotation of the solution body and (2) to reduce separated solids from collecting on the side of flow diverters opposite of the direction of flow.

Flow diverters 60 are depicted in FIG. 8 as two fins diametrically opposed from each other and affixed to opposing interior peripheral walls 16 of holding vessel 10. When the apparatus of the present invention is used in CMP operations for homogeneous mixing of slurry, flow diverters 60 ideally are comprised of a plastic material such as polypropylene, or teflon, or a perflouroalkoxy material (PFA), and all components of the apparatus would, ideally be composed of the same, homogeneous material (i.e., the holding vessel, jet mixing assembly, flow diverters, and whirlpool reduction cap). However, the apparatus described herein is not limited in applicability to mixing of chemical slurries, but could also be employed in other applications on the same or different scales, in which case, the composition of the components may vary depending on the application and could be, for example, comprised of steel, or other materials, rather than plastic.

FIG. 8 also shows whirlpool reduction cap 62, a device that assists in controlling the direction of solution velocity at an outlet or drain 14 of holding vessel 10. This device, described in more detail below, aids both in (1) assisting in providing a uniform velocity component, parallel to the base 54 of the holding vessel 10 to reduce the amount of solid buildup or caking along the walls of holding vessel 10 and (2) altering the "Coriolis Effect" or formation of a whirlpool or vortex which may form when solution is drained from holding vessel 10 at base 54, as explained in more detail below.

Solutions, and in particular, colloidal suspensions such as slurries used in CMP of semiconductor wafers are most effective when delivered to CMP tools in a homogenous state with no air in the supply line delivering solution to these tools. When solution is drained from holding vessel 10 throughout outlet 14, in a vertical direction, pockets of little or no solution movement may be created at the base of the holding vessel. To achieve more uniform distribution of solution at base 54 of holding vessel 10, I have developed a device I shall refer to as a "whirlpool reduction cap" to draw solution in a parallel orientation to base 54 of holding vessel 10. Whirlpool reduction cap 62 as illustrated in FIG. 8 functions to aid in continual cycling of solution in the region near the base 54 or outlet/drain 14 of holding vessel 10.

The placement of whirlpool reduction cap 62 is illustrated in FIG. 8. Whirlpool reduction cap 62 is affixed at base 54 of the holding vessel 10 above the outlet port or drain 14. In its second role, the whirlpool reduction cap serves to decrease vortex formation in the solution body. As solution or slurry is demanded by a process tool 32 solution level 20 will decrease. As solution is continually cycled, the solution is orientated in a downward direction and velocity toward outlet, or drain port 14. This creates what is known as a "Coriolis Effect" in the moving solution body which is seen as a vortex or whirlpool about a centerline of the drain. A vortex forming in lower solution levels tends to draw air into supply line 38 as the result of suction created by pump 30. Any air drawn into outlet line 52 will decrease the overall performance of the solution delivery system and interfere with inline instrumentation monitoring the performance of the system.

If, however, the direction of the solution velocity at the drain point is altered, the "Coriolis Effect" is changed. The overall velocity direction being perpendicular to the above orientation of the solution velocity creates multiple vortices, which tend to cancel each other out.

Figure 10:
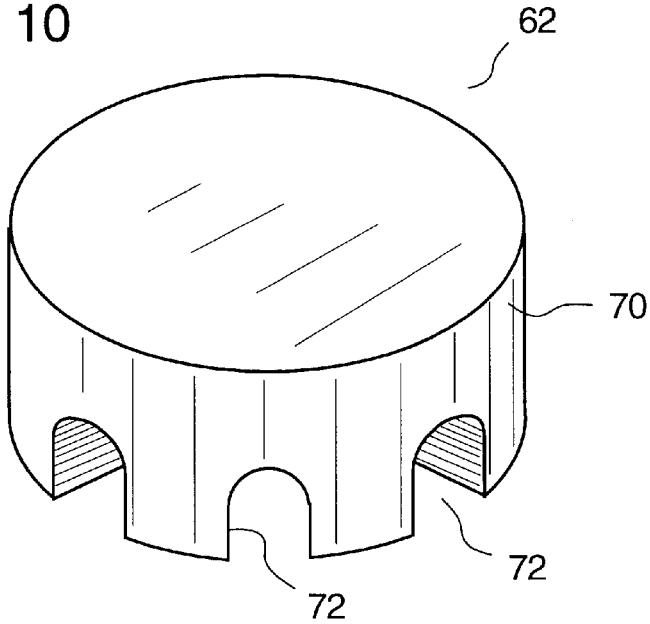
FIG. 10 illustrates a top view of a whirlpool reduction cap of the present invention.
Figure 11:
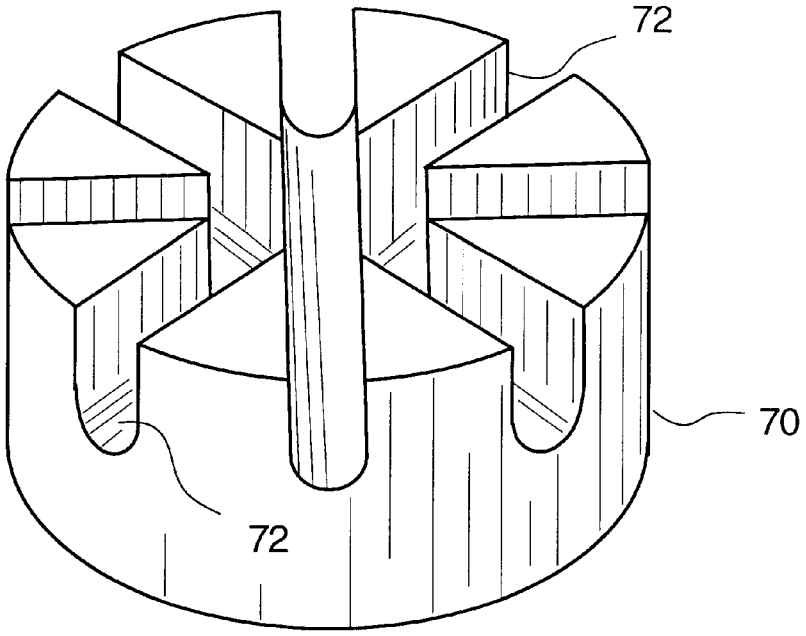
FIG. 11 illustrates a bottom view of a whirlpool reduction cap of FIG. 10.
Figure 12:
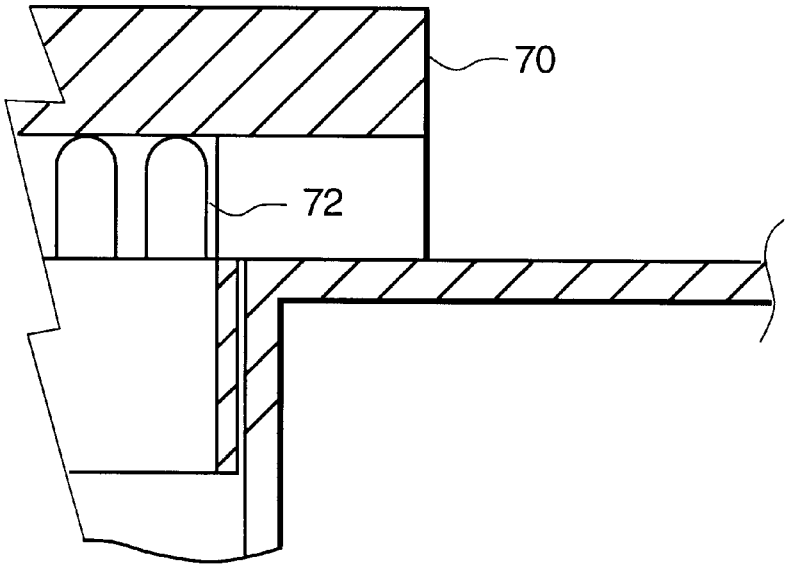
FIG. 12 illustrates a cross-sectional view of the whirlpool reduction cap of FIG. 10.

As shown in FIGS. 10 and 11, whirlpool reduction cap 62 comprises a formed body 70 ideally made of material which is homogeneous with other components of the mixing apparatus. Formed body 70 has inlet ports 72 extending through its sides to channel solution through the body and into outlet 14 at base 54 of holding vessel 10 as depicted in the cross sectional view shown in FIG. 12. Whirlpool reduction cap may be affixed at the base 54 of holding vessel 10 by welding or by adhesive means, such as bonding adhesives.

Figure 13:
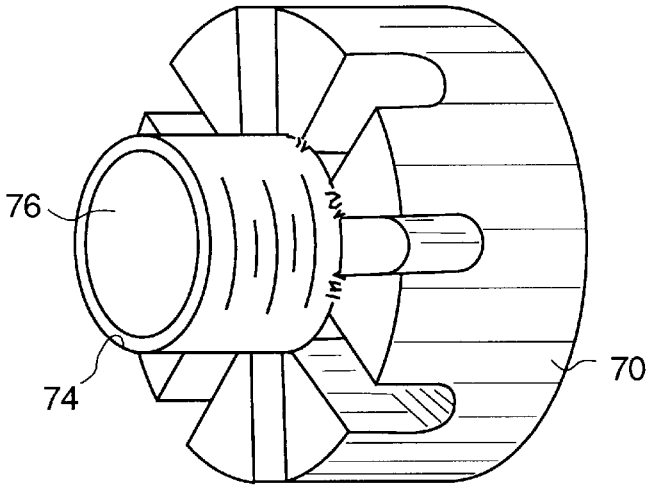
FIG. 13 illustrates a side view of another embodiment of the whirlpool reduction cap of the present invention.
Figure 14:
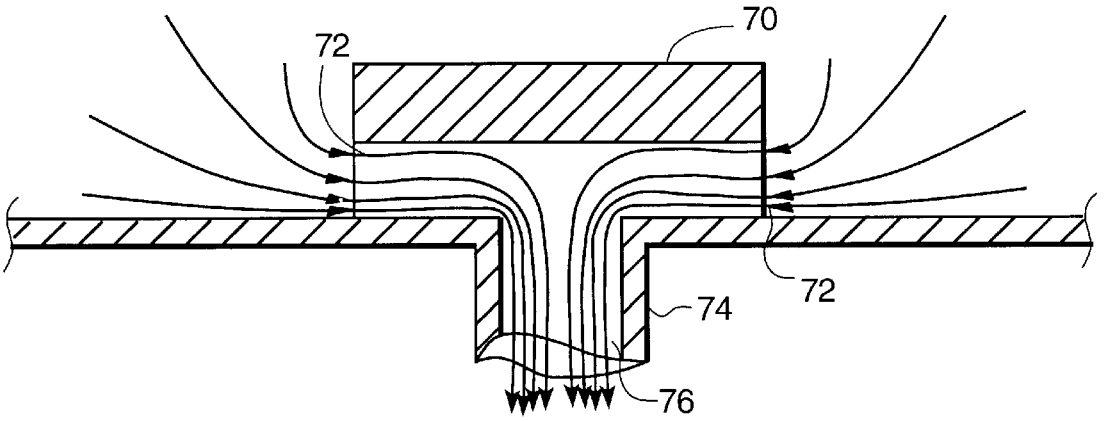
FIG. 14 illustrates a cross-sectional view of the bottom view of the whirlpool reduction cap of FIG. 13.

In another embodiment, as illustrated in FIG. 13, whirlpool reduction cap 62 also includes a chute 74 having a channel 76 extending from the base of the formed body. Chute 74 can be used to secure whirlpool reduction cap 62 in outlet 14 at the base of holding vessel 10. Chute 74 may be threaded for screwing the whirlpool reduction cap into a threaded drain of holding vessel 10. Alternatively, chute 74 may be tapered or smooth and may be pressed fit into a non-threaded drain of the holding vessel.

The streamlines created from the varied orientation are situated parallel to the base 54 of holding vessel 10. These streamlines tend to channel solution towards the drain which help to provide a lower solid content at the base than without any device. The whirlpool reduction cap 62 reduces the effect of air entrapment by altering the direction of the solution being drawn into the system through the drain. This reduction of whirlpool formation helps to assist in the amount of usable slurry volume inside the holding vessel. Also, because the direction of the outgoing slurry is parallel with the base of the holding vessel, a better state of agitation towards the bottom of holding vessel, 10, is developed. Slurry at the base holding vessel 10 is drawn into the drain while upper layers replenish this void and there is less likelihood of settling over time through the continuous cycling process.

EXAMPLES

Example I

A mixing apparatus having two jets was constructed in accordance with the description of the apparatus shown in FIG. 2 but with two rather than four jets. The following is a detailed description of the construction and test results.

a. Materials Used

MEGAflow™ IIIb Fixture w/Global Loop Simulator

Two Jet Mixer, Prototype Unit

Atomizer Fixture

Flowmeter, PEEK Polysonics, DDF-5088

Slurry, RODEL QCTT-1011

Sampling Apparatus b. Procedure

A two jet mixing head was fashioned out of existing parts on hand. A ¾" PFA T-fitting was mounted to the inlet port at the top of 30 gallon holding vessel and positioned so that the jets were colinear with the diameter of the holding vessel and parallel to the plane of the solution level. The PFA tubing from the T-fitting was reduced to a ⅜" tubing diameter and 90° elbows were connected. The orientation of the elbows were situated so that the outgoing stream of solution was tangent to the inner surface of the holding vessel and coplanar to the solution level. Inner diameters of ⅜" elbows were bored out so that the total area of outgoing solution was 1.5 times smaller than the standard area of the ¾" PFA tubing. The orientation of overall solution rotation was in a counter-clockwise motion.

A global solution loop was run for 18 hours at 30 psi. Data pertaining to pump pressure, density, pH, and flow rate were downloaded into a Allen-Bradley SLC-500 Programmable Logic Circuit during the course of operation.

The holding vessel was segmented in 1" intervals to represent the distribution according to solution level. The circulating pump was shut off and all valves leading to the system were closed. The holding vessel was drained under static conditions during sample gathering. Two samples of slurry were gathered at each solution level. A total of 22 pairs of data were collected. The overall time of draining during sample acquisition was about 25 min.

Observations of the solution surface prior to draining revealed a thin layer of settled material at the center of the solution surface. The diameter of the settled region was about 4–5 in. and its maximum depth was estimated to be around 4 cm. This was attributed to the circular motion of the entire system. The velocity of the solution seems to be slower at the center than at the edges, where the jets stir the system.

The holding vessel was inspected upon completion of draining to observe any signs of caking or build-up on the interior wall or sludge deposits at the base. Caking thickness on the interior wall varied. Where the solution flow path struck the inner surface and fell downward under gravitational influence there were no signs of caking. The region that caking developed varied from 0.5 to 1.0 mm in thickness. The volume of resulting caking was calculated to be 100 MI. The base of the holding vessel showed slight signs of sludge buildup. the resulting volume was calculated to be 200 MI.

Example II

Four Jet Mixer a. Materials Used

MEGAflow™ IIIB Fixture w/Global Loop Simulator

Four Jet Mixer, Prototype Unit

Atomizer Fixture

Slurry, RODEL QCTT-1011

Sampling Apparatus b. Procedure

A four jet mixing assembly was fashioned out of existing parts on hand. A ¾" female thread tapped at the center of the cross, perpendicular to the orientations of the openings. Each of the four openings was reduced to accept ⅜ Flaretek-½" NPT PFA fittings by gluing the appropriate reducers. Approximately 5.1" of flared ⅜" PFA tubing was connected to each of the PFA fittings. Each of the PFA tubes were connected to ⅜"90° elbows. The entire assembly (in the form of a cross) was mounted so that the center of the cross was colinear to the centerline of the holding vessel. The orientation of the outlets of the elbows (jets) were situated so that the outgoing stream of solution was tangent to the inner surface of the holding vessel and coplanar to the solution level. The total area of outgoing solution was 1.56 times smaller than the standard area of the ¾" PFA tubing. The orientation of overall solution rotation was in a counter-clockwise motion.

The plane created by the centerlines of the four individual jets of the mixer body sat 4" lower than the centerline of the PFA bulkhead at the top of the holding vessel. This reduced the overall initial volume of the slurry body from 23 gallons to 19 gallons.

A global loop ran for 18 hours at 30 psi. In order to speed up overall vessel drainage and reduce any error to the data from settling during a static draining of the holding vessel, the vessel was segmented in 2" intervals to represent the distribution according to solution level. The pump was shut off and all valves leading to the system were closed. The holding vessel was drained under static conditions during sample gathering. Two samples of slurry were gathered at each solution level. A total of 14 pairs of data were collected. The overall time of draining during sample acquisition was about 15 min.

Observations of the solution surface prior to draining revealed a thin layer of settled material at the center of the solution surface. The diameter of the settled region was about 4–5 in. and its maximum depth was estimated to be around 0.4 cm. This was attributed to the helical the solution in the vessel. The velocity of the solution appeared somewhat slower at the center than at the edges, where solution from the jets stirs the solution body.

The vessel was inspected upon completion of draining the slurry to observe any signs of caking on the interior wall or sludge deposits at the base of the vessel. Caking thickness on the interior peripheral wall varied. Where the solution flow path struck the inner surface and fell downward under gravitational influence there were no signs of caking. The region where caking developed varied from 0.5 to 1.0 mm in thickness. The volume of resulting caking was calculated to be 100 mL. The base of the vessel showed slight signs of sludge buildup. The resulting volume was calculated to be 200 mL.

Example III

Four Jet Mixer With Fluid Diverters and Whirlpool Reduction Cap a. Materials Used MEGAflow™ IIIb Fixture w/Global Loop Simulator Four Jet Mixer, Prototype Unit Whirlpool Reduction Cap, Prototype Unit PLC Data Fixture Atomizer Fixture Slurry, RODEL QCTT-1011

Sampling Apparatus b. Procedure

A whirlpool reduction cap was fashioned from a 2" PVC end cap. The lateral side of the cap had four slots approximately ½" wide and ⅝" high cut in four equal places.

From previous observations, the center of the solution body located at the solution level showed some settling. To increase center homogeneity, two flow diverters were built from ½" thick natural polypropylene sheets. The diverters were 1.5"×21". Two sets of ½" holes were drilled at ⅝" apart and each set has 14 holes 1.5" apart.

A Flouroware T-fitting was connected between the inner wall of the holding vessel and the four jet mixer. The T-fitting was reduced to ⅜" diameter tubing and a Parker PTFE needle valve was mounted at the end. During system operation at 40 psi, the needle valve was allowed to bleed off material at approximately 30 ml/min. This flow represented the demand of the slurry to a tool. It was used for sampling the solution drawn from the base of the holding vessel during the empirical analysis.

Example IV

Whirlpool Reduction Cap

Initial use and testing of the whirlpool reduction cap were tried during a single jet test with deionized water in order to quell whirlpool formation. During the test of the four jet assembly, when the system was refitted with the diverters and the whirlpool reduction cap, an overall improvement was observed both in the empirical and visual data gathered.

Overall improvements were observed during post test inspection of the drained holding vessel when the whirlpool reduction cap was affixed to the drain. The overall direction of the drainage was changed from a true vertical direction to a nearly planar orientation to the base of the vessel. Solution drawn into the drain by the pump interacts more with the surface of the holding vessel and thereby inducing agitation in this region. At regions on the surface of the vessel near the outlet, a significant reduction of sludge was observed.

Example V

Application of Helical Flow Concept

The concept behind helical flow can be explained in mechanical terms. A particle with initial velocity $V_o$ is introduced tangent to the internal surface of a vessel at a ballistic angle, $\Theta$, relative to the solution level. Assuming that effects of friction are negligible, for a first hand approximation, the final velocity of the particle $V_f$, is a function of $V_o$ and the vertical distance of the particles descent. This calculation serves as a reference to the maximum obtainable speed of the particle in order to develop a maximum Reynolds Number for solution moving over a surface. Actual speed would be lower and comprise of a range of values since the solution is fanning out over the surface and the skin thickness of the solution is decreasing during the fall.

In this invention, through the continual improvements in the jet arrangement, it was observed that the more jets added to the multiple jet assembly, the better the overall homogeneity of the solution body. From the data generated, complimented by the visual observations, each jet assembly showed a significant improvement in terms of homogeneity of the colloidal suspension. The improvements were based on statistical deviations from the percent solids data and the post drain state of the holding vessel. As the number of jets moved from the sparger head of the prior art to a two jet orientation, the statistical deviation moved from ±0.35% to ±0.23% non volatile solids. Also, a post drain state of the holding vessel revealed a decrease of settled solids from 1.6 L down to 0.3 L which led to the increased jet assembly for the four jet assembly. The four jet assembly aided to decrease the statistical deviation from the two jet assembly ±0.23% down to the four jet assembly ±0.11% non volatile solids. Also, a post drain state revealed a decrease of settled solids from 0.3 L down to 0.225 L.

Additionally, it was observed that delivering solution or slurry near the top of the vessel provides optimal cycling and helical mixing of the solution in the vessel and throughout the cycling process. Although in the preferred embodiment of the present invention the jet assembly would be situated above the solution level rather than beneath the solution level, it is not necessary that the jet assembly be so situated. The assembly could be located beneath the solution level and still create the helical flow pattern of the present invention if the jet outlets are placed to deliver slurry tangent to a horizontal plane of the solution level and at the angular positions previously discussed.

The addition of the flow diverters and whirlpool reduction cap to the four jet assembly assisted in an improved homogeneity of the colloidal suspension by reducing the overall statistical deviation from ±0.11% down to ±0.09% non volatile solids. The post drain state of the holding vessel revealed 0.15 L total settled solids. Final improvements over the course of the test showed a order of magnitude (10×) reduction of settled solids which was complemented by the statistical reduction in the overall sampling four-fold.

This invention is not limited by the examples set forth above. Obviously, numerous modifications and variations of the present invention are possible in light of the above teachings. It is therefore to be understood that within the scope of the appended claims, the invention may be practiced otherwise than as specifically described herein.

I claim:

1. An apparatus for providing a homogeneous solution comprising:

a holding vessel for holding a solution body, said holding vessel having a top, a base, and interior peripheral walls;

a delivery line extending into the holding vessel, the delivery line having a diameter, $D_1$;

a jet mixing device extending from the delivery line, said jet mixing device having a plurality of lateral members, each having a diameter, $D_2$, in fluid communication with the delivery line, wherein each said lateral member has a jet outlet positioned above the solution body and tangent to an interior peripheral wall of said holding vessel for introducing a stream of a solution into said holding vessel tangent to said interior peripheral walls at a ballistic angle $\Theta_2$ to a horizontal plane of said solution body thereby creating a helical flow in said solution body, wherein the sum of the squares of $D_2$ is less than the square of $D_1$; and a circulating pump in communication with the delivery line and said holding vessel for continuously circulating said solution through said holding vessel and said jet mixing device.

2. The apparatus as claimed in claim 1, wherein the lateral members are arranged at predetermined angles to each other.

3. The apparatus as claimed in claim 1, further including at least one flow diverter situated interior to said holding vessel for directing flow of said solution toward the center of said holding vessel.

4. The apparatus as claimed in claim 3, wherein said flow diverter comprises at least one fin member extending from an interior peripheral wall of said holding vessel situated inline with a flow path of said solution.

5. The apparatus as claimed in claim 3, wherein said flow diverter is equipped with a plurality of orifices for directing a portion of the solution coming into contact with said diverter through said diverter.

6. The apparatus as claimed in claim 1, further including a whirlpool reduction cap affixed at said base of said holding vessel near an outlet of said holding vessel for decreasing whirlpool formation as solution exits said holding vessel.

7. The apparatus as claimed in claim 6, wherein said whirlpool reduction cap comprises a formed body having a top, a base, a side, and a plurality of inlet ports positioned in the side.

8. The apparatus as claimed in claim 1, wherein said holding vessel is a substantially cylindrical container.

9. The apparatus of claim 1, wherein angle $\Theta_2$ ranges between 0° and 60° above the solution body.

10. The apparatus of claim 9, wherein angle $\Theta_2$ is 15° above the solution body.

11. An apparatus for providing a homogeneous solution comprising:

a holding vessel for holding a solution body, said holding vessel having a top, a base, and interior peripheral walls;

a delivery line extending into said holding vessel;

a stationary mixing device extending from said delivery line in fluid communication with said delivery line, said mixing device comprising:

a mixer junction connected in fluid communication with said delivery line;

a jet assembly extending from said mixer junction, wherein said jet assembly comprises a plurality of jet members connected to said mixer junction, each said jet member having a jet outlet positioned above the solution body and tangent to an interior peripheral wall of said holding vessel;

a circulating pump in communication with said mixing device and said holding vessel for continuously circulating said solution through said holding vessel and said mixing device.

12. The apparatus as claimed in claim 11, including at least four jet members.

13. The apparatus as claimed in claim 11, further including a flow diverter extending from the interior of said holding vessel for directing solution flow toward a center of said holding vessel.

14. The apparatus as claimed in claim 13, wherein said flow diverter comprises at least one fin member extending from an interior peripheral wall of said holding vessel, said fin member being equipped with a plurality of orifices for directing a portion of the solution coming into contact with said fin member through said fin member.

15. The apparatus as claimed in claim 11, further including a whirlpool reduction cap connected to the base of said holding vessel in communication with a solution exit point in said holding vessel.

16. The apparatus as claimed in claim 15, wherein said whirlpool reduction cap comprises a formed body having a top, a base, and a plurality of inlet ports, each said inlet port having a center plane being perpendicular to a center plane of said solution exit point of said holding vessel.

17. The apparatus as claimed in claim 15 wherein said whirlpool reduction cap further comprises a chute having a channel extending from said base of said formed body for securing said whirlpool reduction cap through a solution exit port in said holding vessel.

18. An apparatus for providing a homogeneous solution comprising:

a holding vessel for holding a solution body, said holding vessel having a top, a base, and interior peripheral walls;

a delivery line extending into said holding vessel;

a mixing device extending from, and in fluid communication with, said delivery line, said mixing device comprising:

a mixer junction, and a jet assembly extending from said mixer junction, wherein said jet assembly comprises a plurality of jet members connected to said mixer junction, each said jet member having a jet outlet positioned above the solution body and tangent to an interior peripheral wall of said holding vessel;

a circulating pump in communication with said mixing device and said holding vessel for continuously circulating said solution through said holding vessel and said mixing device; and a whirlpool reduction cap positioned near an outlet of said holding vessel.

19. The apparatus as claimed in claim 18, wherein said whirlpool reduction cap comprises a formed body having a top, a base, a side and a plurality of inlet ports positioned in the side.

20. The apparatus as claimed in claim 19, wherein said whirlpool reduction cap further comprises a chute having a channel extending from said base.

21. An apparatus for providing a homogeneous solution comprising:

a holding vessel for holding a solution body, said holding vessel having a top, a base, and interior peripheral walls;

a flow diverter positioned within said holding vessel;

a delivery line extending into said holding vessel; a mixing device extending from, and in fluid communication with, said delivery line, said mixing device comprising:

a mixer junction, and a jet assembly extending from said mixer junction, wherein said jet assembly comprises a plurality of jet members connected to said mixer junction, each said jet member having a jet outlet positioned above the solution body and tangent to an interior peripheral wall of said holding vessel;

a circulating pump in communication with said mixing device and said holding vessel for continuously circulating said solution through said holding vessel and said mixing device; and a whirlpool reduction cap positioned near an outlet of said holding vessel.

22. The apparatus as claimed in claim 21, wherein said flow diverter comprises at least one fin member extending from an interior peripheral wall of said holding vessel situated inline with a flow path of said solution.

23. The apparatus as claimed in claim 21, wherein said flow diverter is equipped with a plurality of orifices.

* * * * *